US005381632A

United States Patent [19]

Damron

[11] Patent Number: 5,381,632

[45] Date of Patent: Jan. 17, 1995

[54] CHIMNEY FLASHING SYSTEM

[76] Inventor: Matthew Damron, 533 S. Bayside, Detroit, Mich. 48217

[21] Appl. No.: 55,299

[22] Filed: May 3, 1993

[51] Int. Cl.[6] ..... E04D 1/36

[52] U.S. Cl. ..... 52/58; 52/60; 52/62; 52/200

[58] Field of Search ..... 52/56, 57, 58, 59, 60, 52/61, 62, 68, 218, 219, 94, 95, 100, 200

[56] References Cited

U.S. PATENT DOCUMENTS

| | | | |
|---|---|---|---|
| 3,124,427 | 3/1964 | Chomes | 52/62 |
| 4,603,517 | 8/1986 | Lyons, Jr. | 52/60 |
| 4,781,008 | 11/1988 | Lyons, Jr. | 52/58 |
| 4,799,986 | 1/1989 | Janni | 52/58 |
| 4,932,171 | 6/1990 | Beattie | 52/58 |
| 4,951,431 | 8/1990 | Sweers | 52/60 |
| 5,053,266 | 10/1991 | Hesketh et al. | 52/60 |
| 5,072,552 | 12/1991 | Sauder | 52/58 |

*Primary Examiner*—Carl D. Friedman
*Assistant Examiner*—Winnie Yip
*Attorney, Agent, or Firm*—Gifford, Groh, Sprinkle, Patmore and Anderson

[57] ABSTRACT

A flashing system is provided for a chimney. The flashing system includes an elongated base flashing which is generally L-shaped within cross section thus having two generally planar legs which intersect each other along a mid-line of the base flashing. One leg of the base flashing is attached to the roof so that the other leg of the base flashing extends upwardly from the roof along one side of the chimney. An elongated and generally planar counter-flasher is then secured to the chimney above the top edge of the base flashing so that the counter-flashing overlaps the other leg of the base flashing. Ceiling caulk is also provided between the counter-flashing and the chimney in order to seal the counter-flashing to the chimney against the elements.

4 Claims, 2 Drawing Sheets

CHIMNEY FLASHING SYSTEM

BACKGROUND OF THE INVENTION

1. Field of the Invention

The present invention relates to a flashing system for a chimney.

2. Description of the Prior Art

In order to prevent water leakage around a chimney extending upwardly from the roof, it is necessary to seal the chimney against water leakage. In the past, there have been several previously known means for doing so.

One system for sealing the chimney is simply to provide tar or other sealants around the base of the chimney so that a portion of the tar is covered by shingles attached to the top of the ceiling. This particular method, however, is prone to leakage and, in many cases, not permitted by building codes.

Rather, most building codes require that a flashing be provided around the base of the chimney. These flashings are generally L-shaped in cross sectional shape and come in short sections, e.g., eight inches long. The flashings partly overlap each other and are secured to the roof by pails or the like. While this type of previously known flashing is generally affective for sealing the chimney against water leakage, such flashings are difficult and time consuming to install. Furthermore, if improperly installed, the flashing will leak.

SUMMARY OF THE PRESENT INVENTION

The present invention provides a flashing system for a chimney which overcomes all the above-mentioned disadvantages of the previously known devices.

In brief, the flashing system of the present invention comprises an elongated base flashing which is generally L-shaped in cross section. Thus, the base flashing has two elongated and generally planar legs which intersect each other along a midpoint of the flashing.

One leg of the base flashing is secured to the roof by nails so that the other leg of the base flashing extends upwardly from the roof along the bottom of the chimney. Any conventional means, such as nails, are utilized to secure said one leg of the base flashing to the roof and this leg of the base flashing is adapted to be covered by shingles on the roof.

An elongated and generally planar counter-flashing is then secured to the chimney above the top edge of the second leg of the base flashing so that the counter-flashing overlaps the second leg of the base flashing. This counter-flashing is then fluidly sealed to the chimney by applying a bead of caulk between the chimney and the top edge of the counter-flashing.

In the preferred embodiment of the invention, an elongated sealing strip extends along the entire length of the first leg of the base flashing. This sealing strip includes an adhesive upper surface adapted to sealing fluidly engage shingles which are positioned over the first leg of the base flashing along both the sides and the top base flashing and along the bottom of the bottom flashing. Additionally, this first leg of the base flashing along the sides preferably includes at least one, and preferably two, raised ridges which form a water dam for any water which seeps underneath the shingles.

BRIEF DESCRIPTION OF THE DRAWING

A better understanding of the present invention will be had upon reference to the following detailed description which read in conjunction with the accompanying drawing, wherein like reference characters refer to like parts throughout the several views and in which.

DETAILED DESCRIPTION OF THE PREFERRED EMBODIMENT OF THE PRESENT INVENTION

Figure 1:
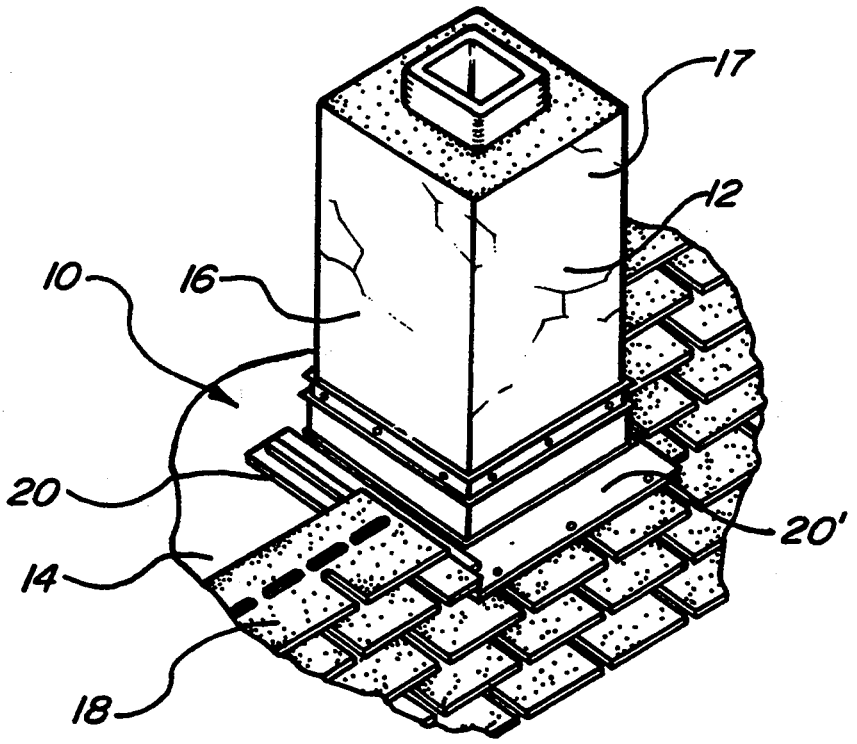
FIG. 1 is a fragmentary, elevational view illustrating a preferred embodiment of the present invention.

With reference first to FIG. 1, a preferred embodiment of the flashing system 10 of the present invention is thereshown for sealing a chimney 12 to a roof 14 against water leakage. The chimney 12 has two sides 16 (only one shown), a bottom side 17, a top side 19 (FIG. 4) and extends upwardly from the roof 14. In addition, the roof 14 is covered by conventional shingles 18.

Figure 3:
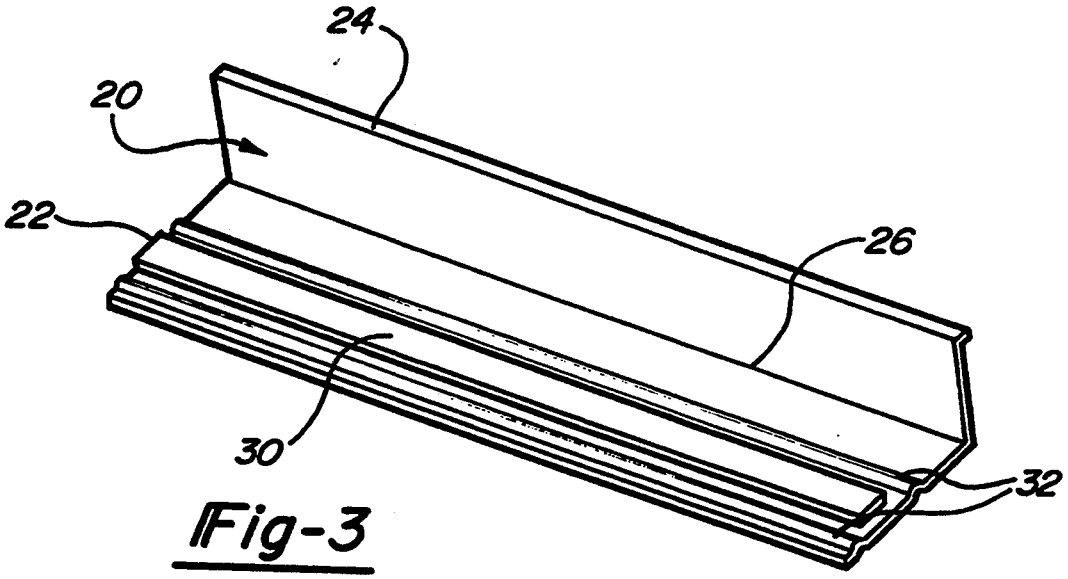
FIG. 3 is an elevational view illustrating a preferred embodiment of the base flashing of the present invention.
Figure 4:
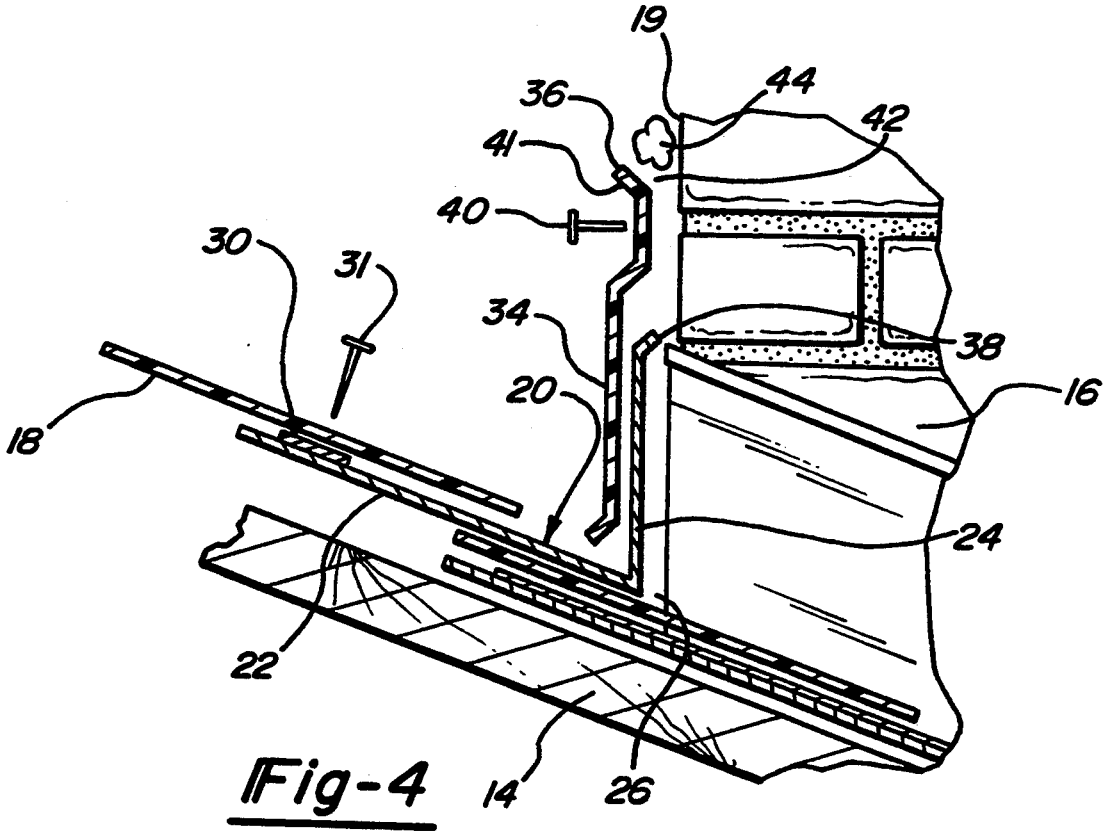
FIG. 4 is a fragmentary exploded sectional view of the top section of the flashing system.

With reference now to FIGS. 3 and 4, the flashing system 10 provided along the top side 19 and sides 16 of the chimney includes an elongated base flashing 20 which is generally L-shaped in cross section. As such, the base flashing 20 includes a first leg 22 and a second leg 24 which intersect each other along a mid-line 26 extending along the length of the base flashing 20. The base flashing 20 is constructed from any conventional material, such as sheet metal and extends along the entire length of its respective side 16 or 19 of the chimney 12.

With reference now especially to FIGS. 1 and 3, the base flashing 20 further includes an elongated sealing strip 30 extending along the length of the first leg 22 of the base flashing 20. This sealing strip 30 is preferably a foam strip having an adhesive strip on its upper side. As best shown in FIG. 1, the base flashing 20 is provided along the sides 16 and 19 of the chimney 12 so that the sealing strip 30 is adapted to be covered by the shingles 18. In doing so, the sealing strip 30 is adhesively secured to the bottom of the shingles 18 thus sealing the base flashing 20 to the shingles 18 against leakage. Conventional fasteners, such as nails 31 (FIG. 4) are driven through the shingles 18, sealing strip 30, base flashing 20 and into the roof 14 to secure the base flashing 20 to the roof 14. The nails 31 form the sole means for attaching the base flashing 20 to the roof 14 so that one leg of the base flashing 20 is free floating.

As best shown in FIG. 3, the base flashing 20 includes at least one, and preferably two, raised ridges 32 which extend along the first leg 22 on opposite sides of the sealing strip 30. These raised ridges 32 form a dam for any water which may seep under the shingles 18 adjacent the chimney 12 so that the ridges 32 channel the water downwardly along the slope of the roof 14.

Figure 2:
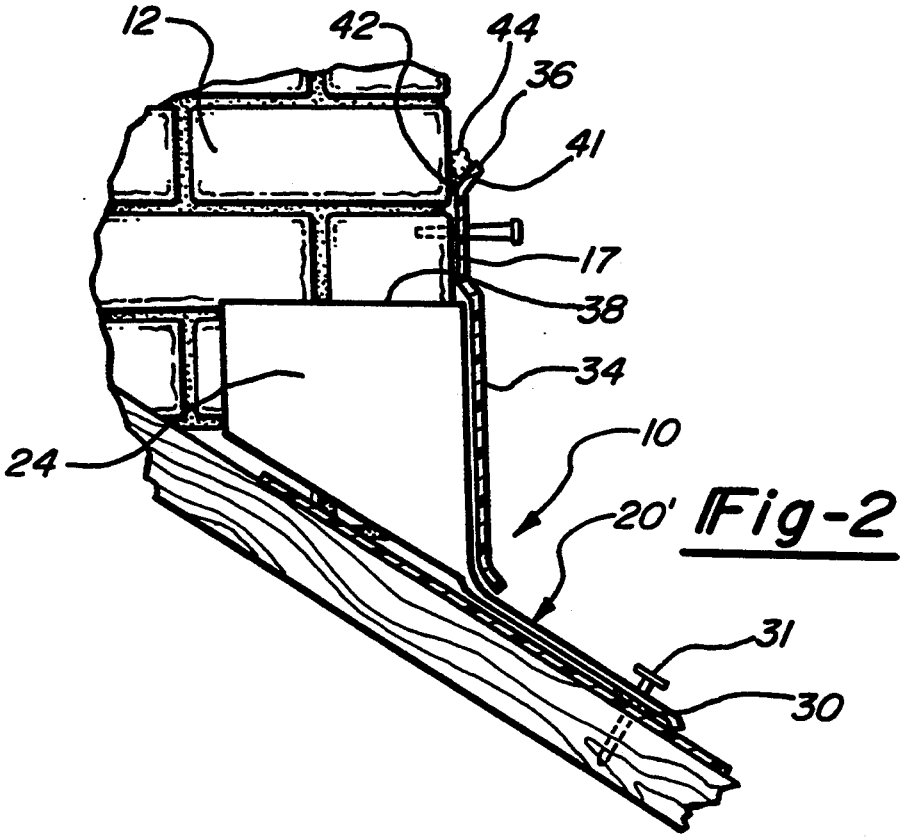
FIG. 2 is a fragmentary sectional view of the bottom section of the flashing system.

With reference now especially to FIGS. 1 and 2, a modified base flashing 20' is provided for the side valve of the chimney 16 on the downward slope of the roof 14 along its bottom side 17. Since this base flashing 20' is secured on top of the shingles 18, both the sealing strip 30 and the raised ridges 32 are omitted from the top of this base flashing 20'. Instead, a sealing strip 30' is provided along the bottom of the base flashing 20'.

With reference now to FIG. 4, an elongated and generally planar counter-flashing 34 has an upper edge 36 positioned above an upper edge 38 of the base flashing leg 24 and this upper edge 36 of the counter-flashing 34 is secured to the chimney 12 by nails 40 or the like. In doing so, the counter-flashing 34 overlaps the upper leg 24 of the base flashing 20 or 20'. Consequently, any water travelling down the roof is deflected by the counter-flashing 34 onto the base flashing 20 or 20' and thus onto the roof 14.

Still referring to FIG. 4, the counter-flashing 34 preferably includes an outwardly extending lip 41 at its upper end. This lip 41 forms a V-shaped notch 42 between the lip 40 and the chimney 12. After the counter-flashing 34 is secured to the chimney 12, this V-shaped notch 42 is filled with a sealant 44, such as silicon caulk to thereby seal the counter-flashing 34 to the chimney 12.

In practice, the flashing system 10 of the present invention is simple to install and highly effective in operation.

Having described my invention, however, many modifications thereto will become apparent to those skilled in the art to which it pertains without deviation from the spirit of the invention as defined by the scope of the appended claims.

I claim:

1. A flashing system for a chimney having a plurality of sides, said chimney extending upwardly from a roof, said flashing system comprising:

an elongated base flashing, said base flashing being generally L-shaped in cross section thus having two generally planar legs which intersect each other along a midline of said flashing, means for attaching one leg of said base flashing to the roof so that the other leg of said base flashing extends upwardly from the roof along one side of the chimney, said one leg adapted to be covered by shingles on the roof, an elongated and generally planar counter flashing, means for attaching said counter flashing to the chimney above a top edge of said other leg of said base flashing so that said counter flashing overlaps said other leg of said base flashing, a sealing strip extending along the top side said one leg of said base flashing, said sealing strip adapted to engage a bottom side of the shingles, wherein said sealing strip comprises a foam strip, an adhesive on an upper side of said foam strip, and wherein said means for attaching said base flashing to said roof comprises a plurality of nails extending through said one leg of said base flashing through said sealing strip and into the roof, said nails forming a sole means for attaching said base flashing to the roof so that said other leg of said base flashing is free floating.

2. The invention as defined in claim 1 and comprising means sealing said counter flashing to said chimney.

3. The invention as defined in claim 2 where said counter flashing includes an outwardly flared lip along an upper edge, said lip forming a V-shaped notch with the chimney, and wherein said sealing means comprises a caulk bead in said V-shaped notch.

4. The invention as defined in claim 1 and comprising at least one raised ridge extending along the length of said one let of said base flashing, said ridge forming a water dam.

* * * * *